United States Patent [19]

Greenberg

[11] 4,172,321

[45] Oct. 30, 1979

[54] WALL TILE REMOVING TOOL

[75] Inventor: Ronald C. Greenberg, Bel Air, Calif.

[73] Assignee: t.h.e. Original Mirror Company, Chicago, Ill.

[21] Appl. No.: 846,376

[22] Filed: Oct. 28, 1977

[51] Int. Cl.[2] ..... B26B 3/08

[52] U.S. Cl. ..... 30/165; 30/340

[58] Field of Search ..... 30/317, 340, 346, 355, 30/343, 165

[56] References Cited

U.S. PATENT DOCUMENTS

| | | | |
|---|---|---|---|
| 401,181 | 4/1889 | Lee | 30/340 |
| 423,351 | 3/1890 | Streeter | 30/340 X |
| 1,710,039 | 4/1929 | Baur | 30/355 X |
| 3,273,191 | 9/1966 | Chambers | 30/355 X |

*Primary Examiner*—Jimmy C. Peters

*Attorney, Agent, or Firm*—Wallenstein, Spangenberg, Hattis & Strampel

[57] ABSTRACT

A wall tile removing tool comprises a shank portion terminating at the rear thereof in a handle portion and terminating at the front thereof in a thin, blade-like cutting portion of a thickness to fit loosely between a tile and wall surface when it extends parallel to the wall surface. The blade-like cutting portion extends at an angle from the shank portion so that the shank and handle portions of said tool are spaced substantially from the wall surface while the blade-like cutting portion extends parallel to the rear surface of the tile and said wall surface.

8 Claims, 5 Drawing Figures

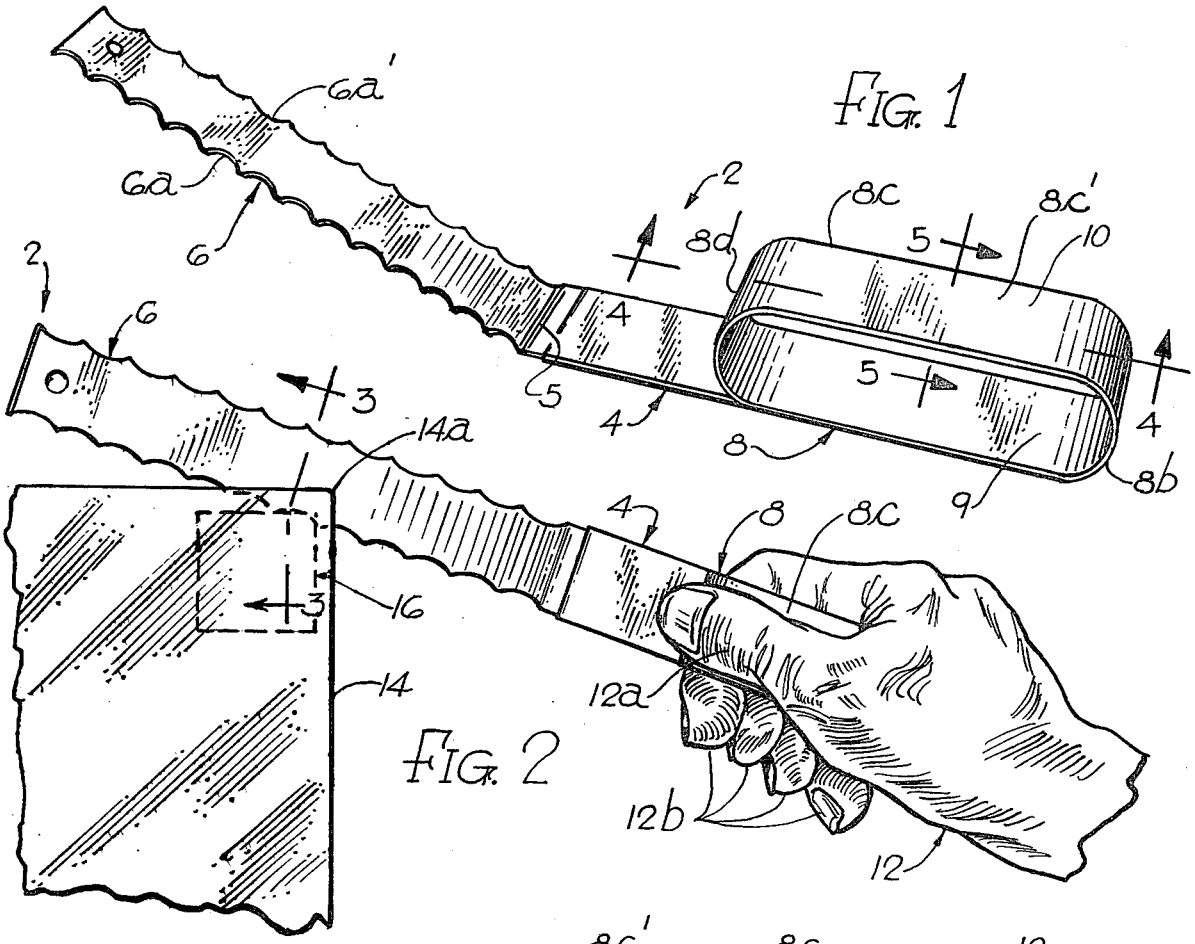
FIG. 1
FIG. 2
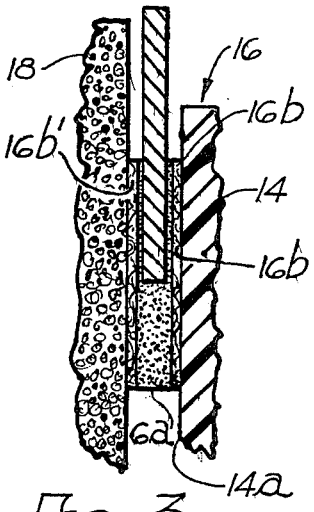
FIG. 3
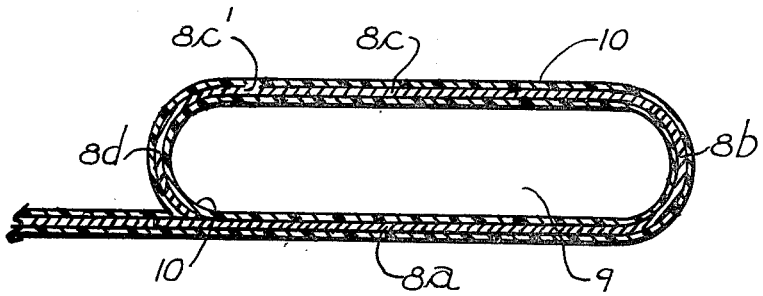
FIG. 4
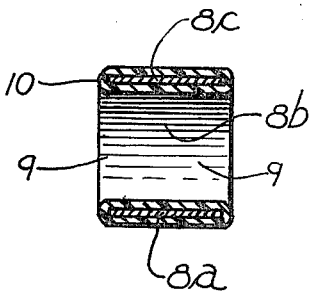
FIG. 5

WALL TILE REMOVING TOOL

BACKGROUND OF INVENTION

This invention relates to a tool for removing wall mounted plates or tiles secured to the wall by tile-anchoring elements secured by a very strong bonding adhesive to the rear surface of the wall tiles and to the wall. Sometimes, such wall tiles are sold in kits (as, for example, disclosed in U.S. Pat. No. 3,589,507) with the tile-anchoring elements initially separate from the tiles so that the tile-anchoring elements must be first applied to corners of the rear surfaces of the tiles. As disclosed in this patent, each tile-anchoring element may comprise a main body or pad portion of polyurethane foam material or the like having a layer of pressure sensitive adhesive on each face thereof initially covered by a releasable layer of paper which is removed to expose the adhesive therebeneath. After a tile-anchoring element is pressed into position adjacent each corner of a wall tile, the tile is then anchored on the wall at the desired point by merely pressing the same against the wall. Because of the nature of the pressure-sensitive adhesive used, it has been an extremely difficult task to remove such a mounted wall tile. Generally, these wall tiles are removed with a putty knife or the like by first positioning the blade thereof within the small space between each wall tile and the wall, and then pulling or pushing the blade through the adhesive-carrying pad constituting the body portion of each tile-anchoring element. This was a difficult task since the handle of the putty knife must generally be spaced from the wall involved to provide clearance for the user's hand, and so the blade of the putty knife had to be pushed and held against the wall to bend the blade so that it could fit behind the tile. The tension on the blade caused it to become wedged between the wall tile and the wall, making it difficult to move the blade.

SUMMARY OF THE INVENTION

In accordance with one of the features of the invention, a tile removal tool is provided with a unique shape, permitting it to be easily inserted into place between a mounted tile and the wall. To this end, the tool has a thin blade-like cutting portion of a thickness to fit relatively loosely between the wall tile and the wall when it extends parallel thereto. In other words, the blade-like cutting portion has a thickness somewhat less than the overall thickness of the main body or pad portion of each tile-anchoring element. Of great importance is the fact that the blade-like cutting portion extends at an angle from the shank portion of the tool, which terminates in a handle portion which is substantially spaced from the wall to provide clearance for the user's hand gripping the handle portion when the blade-like cutting portion thereof is inserted in an untensed parallel position between the wall tile and the wall. The blade-like cutting portion thereof can thus be easily moved through the main body portion of each tile-anchoring element to sever the connection of each wall tile from the wall at the severance point involved. At least one, and preferably both, laterally facing, longitudinally extending edges of the blade-like cutting portion of the tool have a saw-toothed shape, so that, assuming a horizontal orientation of the tool, inserted behind a wall tile mounted on a vertical wall, either the upper or lower edge of the blade-like cutting portion can be used to cut through a tile-anchoring element by a back-and-forth motion applied to the tool.

Generally, one has access to only two exposed corners of the wall tile to be removed, and, therefore, ready access to the tile-anchoring element at the third and fourth corner of the wall tile is not provided unless the blade-like cutting portion of the tool is given a length at least equal to a tile width, which is generally 12 inches. However, such a blade length is unnecessary because once two of the tile-anchoring elements are severed, the third and fourth tile-anchoring elements can be readily pulled from the wall surface along with the wall tile by a relatively small pulling force applied to the partially loosened wall tile. However, the blade-like cutting portion of the tool is preferably between 5 and 6 inches long so that a single back and forth motion of the tool will cut through a tile-anchoring element.

Other features of the invention relate to the specific constructional details of the wall tile removing tool which enable it to be manufactured at a very low cost and to be most comfortably held by the user. A description of these additional details of the preferred embodiment of the invention can be obtained by making reference to the drawings and to the specification to follow.

DESCRIPTION OF THE DRAWINGS

FIG. 1 is a perspective view of the preferred wall tile removing tool of the invention;

FIG. 2 is a vertical elevational view of a wall, with a wall tile mounted thereon and the tool shown in FIG. 1 being held in a position to cut through a tile-anchoring element at a corner of the wall tile;

FIG. 3 is a greatly enlarged, fragmentary section through the wall tile, tool and wall shown in FIG. 2, taken along section lines 3—3 shown therein;

FIG. 4 is a somewhat enlarged longitudinal sectional view through the handle portion of the tool shown in FIG. 1, taken along section line 4—4 shown therein; and FIG. 5 is a somewhat enlarged, transverse sectional view through the handle portion of the tool shown in FIG. 1, taken along section line 5—5 therein.

DESCRIPTION OF PREFERRED FORM OF INVENTION

Referring now more particularly to FIG. 1, the preferred wall tile removing tool of the present invention shown therein and generally indicated by reference numeral 2 is formed from a strip of sheet metal, which may be steel or aluminum, bent along a transverse line 5 to form a straight blade-like cutting portion 6 which extends at an angle to a flat straight shank portion 4. The angle between the shank and blade-like cutting portion is preferably less than 45 degrees and, most advantageously in the range of from 30–40 degrees. The strip is bent in a direction extending in a plane transverse to the respective planes in which the shank and blade-like cutting portions extend, and the oppositely laterally facing longitudinal edges *6a–6a'* of the blade-like cutting portion are preferably given a serrated or toothed profile viewed in a plane parallel to the plane of the blade-like cutting portion 6.

The shank portion 4 terminates at the rear thereof in a handle 8 which includes an inner portion *8a* which forms a generally coplanar extension of the shank portion 4, a hand-grippable, thumb-receiving arm *8c* extending parallel to and spaced outwardly from the shank portion 4 and inner portion *8a* of the handle. The arm *8c* has an outer thumb-receiving surface *8c'* (FIG.

4) facing in the same general direction as said blade-like cutting portion 6a extending away from said shank portion of the tool. The rear end of the arm 8c is connected to the inner portion 8a of the handle by a curved portion 8b, and the front end of the arm 8c joins a curved portion 8d which terminates in contact with or contiguous to the inner portion 8a of the handle 8, where it may be welded thereto. The handle, as illustrated, is formed by reversely bending the strip of sheet metal at the rear end of the inner portion 8a of the handle 8, so that the handle 8 resembles a partially flattened loop, elongated in the direction of the length of the shank portion 4 of the tool, so as to present a laterally facing openings 9—9 into which the users fingers may be readily passed, and wherein the thumb can engage the outer surface 8c' of the arm portion 8c of the handle. As best seen in FIGS. 4 and 5, the handle 8 and part of the shank portion of the tool is coated with a relatively thick layer 10 of a suitable synthetic plastic material, so that the exposed sides of the handle form comfortable to grip rounded surfaces.

FIG. 2 illustrates the manner in which the user's hand relates to the handle 8 during the manipulation of the tool. As thereshown, the arm portion 8c of the handle is readily grasped by the user's hand 12, with the fleshy part of the thumb 12a of the user's hand bearing against the outer arm surface 8c'. The blade-like cutting portion 6 can then be readily inserted in the small space between a wall tile 14 and the wall 18 (see FIG. 3), with the blade-like cutting portion parallel to the rear surface of the wall tile. Because of the angular relationship between the blade-like cutting portion 6 and the shank portion 4 of the tool, the shank portion 4 and handle 8 of the tool are substantially spaced from the wall surface, so that the tool may be readily moved in a back and forth cutting motion to sever a wall tile from the wall without interference from the wall 18. By making the blade-like cutting portion 6 of a thickness much less than the thickness of a wall tile-anchoring element, and of appreciable length (e.g. about 4–6 inches long), an easy single or at most a few back and forth motions of the tool will readily cut through a tile-anchoring element. Since the blade-like cutting portion is much thinner than the clearance space between the wall tile and wall, the back-and-forth movement of the tool is not significantly impeded thereby.

FIGS. 2 and 3 show one of the tile-anchoring elements 16 which secures a corner of the tile 14 to the wall 18. Generally there is one such tile-anchoring element adjacent each corner of the tile. Each of these tile-anchoring elements includes a main body portion 6a, which may be made of a polyurethane material, on opposite surfaces of which are coated a layer 16b–16b' of a suitable pressure sensitive adhesive. Initially, these layers of pressure sensitive adhesive are covered by a layer of paper (not shown) having a release coating which permits the backing paper to be readily peeled from the layer of the pressure sensitive adhesive involved. The tile-anchoring elements are initially separated from the wall tiles to which they are to be applied, and upon removal of the backing paper, one of the adhesive layers thereof is pressed against the wall tile 14 to adhere the tile-anchoring element to the desired point on the wall tile. The wall tile is then positioned adjacent a wall surface where the wall tile is to be mounted, and by pressing the wall tile towards the wall the other pressure sensitive layer of each tile-anchoring element adheres the wall tile to the wall surface involved. As previously indicated, this pressure sensitive adhesive is often so tenacious, that it is difficult to pull the wall tile from the wall when the wall tile is adhered by a number of such tile-anchoring elements 16. This is why it is necessary to sever at least two of these tile-anchoring elements to permit the wall tile then to be pulled free from the wall. As each wall tile is removed from a wall, two corners of the next wall tile exposed thereby will then be accessible to the tool.

It should be apparent that when a number of rows and columns of wall tiles are placed in contiguous relationship on a wall, two or three corners of the outermost wall tiles are exposed for reception of the blade-like cutting portion 6a of the tool 2. The tile-anchoring element 16 on each tile positioned at the inaccessible fourth corner thereof cannot be reached by the tool, unless the blade-like cutting portion 6 thereof had a length equal to the width of the wall tile. While the tool illustrated in the present invention could be so modified, the blade-like cutting portion 6 of the tool preferably has a length of between 4–6 inches. Also, the desired commercial form of the tool is made from a steel strip having a thickness of about 1/32 inches. It should be appreciated that the tool of the invention provides an exceedingly inexpensive and easy to use means for cutting through a tile-anchoring element to release the wall tile from the wall adjacent to at least three corners thereof. Also, it should be understood that numerous modifications may be made in the most preferred form of the tool illustrated in the drawings, without deviating from the broader aspects of the invention.

I claim:

1. A tool for removing a wall tile or the like secured to a wall surface by the rear adhesive surface of tile-anchoring elements secured and positioned at spaced points at the rear of the tile generally adjacent to the margins thereof, each tile-anchoring element having a given thickness which slightly spaces each tile from the wall surface, said tool comprising: a shank portion terminating at the rear thereof in a handle portion sized and shaped to be gripped by the hand of the person to remove said tile and terminating at the front thereof in a thin, blade-like, cutting portion of a thickness to fit loosely between said tile and wall surface when it extends parallel to the wall surface, said handle portion forming a loop elongated in the direction of the length of said shank portion of the tool, so as to present laterally facing openings through which the user's fingers may be readily passed, with his thumb engaging the outer surface of the elongated loop handle portion facing outwardly in a direction transverse to the cutting edge of the blade-like cutting portion of the tool, said blade-like cutting portion having laterally facing, generally parallel, opposite, longitudinal, serrated edges each shaped to cut through each of said tile-anchoring elements when a back and forth cutting motion is applied thereto, and said blade-like cutting portion extending at an angle from said shank portion wherein the shank and handle portion of said tool are spaced from said wall surface while the blade-like cutting portion extends parallel to the rear surface of the tile and said wall surface upon which it is mounted, to provide clearance for the hand of the person gripping said handle portion.

2. The wall tile removing tool of claim 1 wherein said blade-like cutting and handle portions of said tool are integral portions of the same strip of sheet metal.

3. The wall tile removing tool of claim 2 wherein said handle portion thereof is coated substantially over all of its exposed surfaces including the side edges thereof with synthetic plastic material to form a comfortable-to-grip handle with rounded edges.

4. The wall tile removing tool of claim 1 wherein said shank and blade-like cutting portions of the tool are flat, integral portions of the same strip of sheet metal reversely bent back in a plane transverse to the respective planes in which the shank and blade-like cutting portions extend.

5. The wall tile removing tool of claim 4 wherein said handle portion is formed by an extension of the shank portion of said strip of sheet metal curled in a plane transverse to said respective planes to form a longitudinally elongated and extending loop into which the fingers of the user's hand can be extended while the thumb engages an outer surface thereof.

6. The wall tile removing tool of claim 1 wherein said handle portion thereof comprises an inner portion forming a generally coplanar extension of such shank portion, a thumb-receiving portion spaced from said inner portion on the same side of such shank portion from which said blade-like cutting portion extends in a direction away from said shank portion.

7. The wall tile removing tool of claim 1 wherein said blade-like cutting portion of the tool has a length of about at least 4 inches.

8. The wall tile removing tool of claim 7 wherein the length of said blade-like cutting portion thereof is not greater than about 6 inches.

* * * * *